US008172528B2

(12) United States Patent
Kawakami et al.

(10) Patent No.: US 8,172,528 B2
(45) Date of Patent: May 8, 2012

(54) STEAM TURBINE

(75) Inventors: Hiroshi Kawakami, Kanagawa-ken (JP); Yasunori Iwai, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 529 days.

(21) Appl. No.: 12/392,555

(22) Filed: Feb. 25, 2009

(65) Prior Publication Data

US 2009/0220337 A1 Sep. 3, 2009

(30) Foreign Application Priority Data

Feb. 29, 2008 (JP) ..... 2008-050931

(51) Int. Cl.
*F01D 25/24* (2006.01)

(52) U.S. Cl. ..... 415/220

(58) Field of Classification Search ..... 415/220, 415/214.1, 182.1, 103, 134, 177, 126, 213.1, 415/107, 108; 29/463, 411
See application file for complete search history.

(56) References Cited

U.S. PATENT DOCUMENTS

| | | | | |
|---|---|---|---|---|
| 3,942,907 | A * | 3/1976 | Meylan | 415/126 |
| 4,076,452 | A | 2/1978 | Hartmann | |
| 5,605,438 | A | 2/1997 | Burdgick et al. | |
| 6,971,842 | B2 * | 12/2005 | Luniewski et al. | 415/100 |

FOREIGN PATENT DOCUMENTS

JP 2002-235505 A 8/2002

* cited by examiner

*Primary Examiner* — Alexander Gilman
(74) *Attorney, Agent, or Firm* — Foley & Lardner LLP

(57) ABSTRACT

One aspect of the present invention provides a steam turbine comprising a rotor and a casing that installs the rotor inside, wherein the casing comprises an upper-half section and a lower-half section, which are coupled with each other by an upper-half flange and a lower-half flange thereof, wherein the upper-half section includes: a semi-cylindrical wrapper plate extending in an axial direction of the rotor, end plates coupled with the wrapper plate, each of the end plate is disposed perpendicular to the rotor, wherein at least one of axial ends of the wrapper plate includes a wrapper plate projecting portion that projects from the corresponding end plates in the axial direction, and a first end plate reinforcing rib disposed on the outside surfaces of the end plates in a peripheral direction of the inner periphery of the wrapper plate; and a plurality of second end plates reinforcing ribs disposed radially on the outside surfaces of the end plates, wherein the second end plates reinforcing ribs couple the wrapper plate projecting portion with the first end plate reinforcing rib.

19 Claims, 9 Drawing Sheets

PRIOR ART

PRIOR ART

PRIOR ART

STEAM TURBINE

This application claims priority from Japanese Patent Application 2008-050931, filed Feb. 29, 2008, which is incorporated herein by reference in its entirety.

BACKGROUND OF THE INVENTION

1. Field of the Invention

The present invention relates to a steam turbine, more particularly, having an improved structure of a casing especially suitable for a low pressure turbine.

2. Related Art

A steam turbine is mainly composed of a high pressure turbine into which main steam is introduced, an intermediate pressure turbine into which reheated steam is introduced, and a low pressure turbine coupled with a condenser.

A low pressure casing as a pressure vessel of the low pressure turbine is ordinarily divided into upper and lower sections by a horizontal surface through which a rotor axis passes so that a rotor can be easily inserted and an assembly/disassembly performance can be improved. Flanges provided for the respective horizontal portions of the upper and lower sections are fastened with each other by bolts. In a exhaust chamber of the low pressure casing, atmospheric pressure acts on the outside surface of the exhaust chamber, and on the other hand, the exhaust chamber receives the atmospheric pressure from the outside surface side thereof because the inside of the exhaust chamber is made to a vacuum state, and a wrapper plate and end plates of the low pressure casing are deformed so as to be greatly dented inward. To cope with the above matter, various reinforcing structures are employed for the wrapper plate and the end plate of the low pressure casing. One example of such reinforcing structure is disclosed in Japanese Patent Application Laid-Open Publication No. 2002-235505.

In a conventional turbine casing structure including the reinforcing structure disclosed in the above Publication, as shown in FIGS. 8 and 9, for example, a low pressure casing 1 is divided into an upper-half portion 3 and a lower-half portion 4 by a horizontal surface through which a rotor axis 2 passes, and an upper-half flange 5 and a lower-half flange 6 are coupled with each other by means of bolts.

The upper-half portion 3 of the low pressure casing 1 is formed in an approximately semi-columnar shape by a semi-cylindrical wrapper plate 8 extending in an axial direction of the rotor axis 2 and semi-circular end plates 7 disposed on both the ends of the wrapper plate 8, and the lower-half portion 4 is formed in an approximately rectangular prism shape by end plates 9 and side plates 10.

The wrapper plate 8 of the upper-half portion 3 of the low pressure casing 1 is provided with a wrapper plate reinforcing ribs 11 disposed on the outside surface thereof in a peripheral direction with respect to the rotor axis 2 so as to apply rigidity to the wrapper plate 8. Further, as shown in FIG. 8, a plurality of end plate reinforcing ribs 12, which extend in a radial direction (radially) about the rotor axis 2, are joined to the outside surface of the end plates 7 of the upper-half portion 3 by means of welding, for example, so as to also apply rigidity to the end plates 7. In addition to the above arrangement, the rigidity is also applied to the end plates 7 by joining a plurality of lattice-shaped end plate reinforcing ribs 13 to the outside surface of the end plates 7 by means of welding as shown in, for example, FIG. 9.

The low pressure casing 1 is supported to a base 15 by leg plates 14, and the lower-half flange 6 of the lower-half portion 4 of the low pressure casing 1 is coupled with the leg plates 14 through leg plate reinforcing ribs 16.

Further, pipe stays 17, 18 are disposed to the lower-half portion 4 of the low pressure casing 1 to prevent deformation of the end plates 9 and the side plates 10 as shown in FIGS. 8, 9, and 10. The pipe stays 17 are interposed between the end plates 9 and the side plates 10. The pipe stays 18 are interposed between both the ends plates 9 in confrontation with each other in an axial direction of the low pressure casing 1.

Although the portion under the upper-half flange 5 and the lower-half flange 6 is also deformed so as to be dented in the axial direction by an external pressure received by the end plates 7 of the upper-half portion 3, the pipe stays 18 in particular have an effect of preventing such deformation.

In contrast, as shown in FIG. 10, an upper-half center rib 20, which couples the inner surface of the wrapper plate 8, the inner surfaces of the end plates 7, and the upper portion of a cone 19 with each other, is disposed in the upper-half portion 3 of the low pressure casing 1 to thereby secure the rigidity of the wrapper plate 8, the end plates 7 and the cone 19. On the other hand, a lower-half center rib 21, which couples the inner surface of the end plates 9 with the lower portion of the cone 19, is disposed in the lower-half portion 4 so as to secure the rigidity of the end plates 9 and the cone 19.

In a recent technology, since the size of the low pressure casing 1 is increased in accordance with elongation of the length of a blade in the final stage of a steam turbine, an area of the low pressure casing 1 on which external pressure is received is increased. Accordingly, in a conventional structure in which reinforcing ribs are disposed, the end plates 7 of the upper-half portion 3 are bent and deformed in a direction shown by two-dot-and-dash-lines A of FIG. 10 about a portion at which the end plates 7 are jointed to the wrapper plate 8.

In addition, in a case where the wrapper plate 8 is dented and deformed in its entirety by atmospheric pressure in an inside direction shown by two-dot-and-dash-lines B of FIGS. 8 and 10 or bent and deformed in a direction shown by two-dot-and-dash-lines C of FIGS. 8 and 9 about a portion where the upper-half flange 5 of the upper-half portion 3 is fastened to the lower-half flange 6 of the lower-half portion 4, deformation of the low pressure casing 1 cannot be suppressed.

Furthermore, since an internal constructions such as the pipe stays 17, 18 disposed in the upper-half portion 3 and the lower-half portion 4 of the low pressure casing 1, the upper-half center rib 20 and the like are exposed to the gas flow exhausted from the blade in the final stage of the steam turbine, although they achieve a function for securing the rigidity of the low pressure casing 1, there is a possibility that the resistance of a discharge gas flow path is increased and the gas exhaust performance of the low pressure casing 1 is deteriorated.

SUMMARY OF THE INVENTION

The present invention was conceived in consideration of the circumstances encountered in the prior art mentioned above and an object thereof is to provide a steam turbine which can sufficiently secure the rigidity of a low pressure casing against increasing of the size thereof and also improve discharge gas performance of the low pressure casing by reducing the number of internal structural members of the low pressure casing.

The above and other objects can be achieved according to one aspect of the present invention by providing a steam turbine comprising:

a rotor; and a casing that installs the rotor inside, the casing comprising:

an upper-half section; and a lower-half section, which are coupled with each other by an upper-half flange and a lower-half flange thereof, wherein the upper-half section includes:

a semi-cylindrical wrapper plate extending in an axial direction of the rotor;

end plates coupled with the wrapper plate, each of the end plate being disposed perpendicular to the rotor, in which at least one of axial ends of the wrapper plate includes a wrapper plate projecting portion that projects from the corresponding end plates in the axial direction;

a first end plate reinforcing rib disposed on the outside surfaces of the end plates in a peripheral direction of the inner periphery of the wrapper plate; and a plurality of second end plates reinforcing ribs disposed radially on the outside surfaces of the end plates, wherein the second end plates reinforcing ribs couple the wrapper plate projecting portion with the first end plate reinforcing rib.

The present invention of the above aspect may includes the following preferred embodiments or examples.

The upper-half section may further include first wrapper plate reinforcing ribs disposed on the outside surface of the wrapper plate, the first wrapper plate reinforcing ribs being provided, in the axial direction, at the wrapper plate projecting portion, and the second end plates reinforcing ribs.

The end plates may include an end plate projecting portion that projects from the wrapper plate in the radial direction of the rotor, the first wrapper plate reinforcing ribs coupling the end plate projecting portion with the wrapper plate projecting portion.

The upper-half section may further include second wrapper plate reinforcing rib disposed on an outside surface of the wrapper plate in parallel with the end plates.

The wrapper plate projecting portion may be coupled with the upper-half flange.

The upper-half flange may further comprise an upper-half flange projecting portion provided at a coupling position of the wrapper plate projecting portion and the upper-half flange, the upper-half flange projecting portion projecting in a direction along the wrapper plate projecting portion. The upper-half flange projecting portion may be provided in both sides along the wrapper plate projecting portion.

The upper-half flange projecting portion may further comprise a plurality of flange bolt holes so as to fasten the upper-half section to the lower-half section. The lower-half section of the casing may further comprise: a lower-half flange coupled with the upper-half flange of the upper-half section; and a leg plate reinforcing rib provided on outside surface of the lower half section at a position of the lower-half flange.

The first end plate reinforcing rib may be coupled with the upper-half flange. The upper-half flange may further comprise an upper half-flange projecting portion provided at a coupling position of the first end plate reinforcing rib and the upper-half flange, the upper-half flange projecting portion projecting in a direction along the first end plate reinforcing rib. The upper-half flange projecting portion may be provided in both sides along the first end plate reinforcing rib.

The upper-half flange projecting portion may further comprise a plurality of flange bolt holes so as to fasten the upper-half section to the lower-half section.

The lower-half section of the casing may further comprise: a lower-half flange coupled with the upper-half flange of the upper-half section; and a leg plate reinforcing rib provided on outside surface of the lower half section at a position of the lower-half flange.

The end plate projecting portion is coupled with the upper-half flange. The upper-half flange may further comprise an upper-half flange projecting portion provided at a coupling position of the end plate projecting portion and the upper-half flange, the upper-half flange projecting portion projecting in a direction along the end plate projecting portion.

The upper-half flange projecting portion may be provided in both sides along the end plate projecting portion. The upper-half flange projecting portion may further include a plurality of flange bolt holes so as to fasten the upper-half section to the lower-half section.

The lower-half section of the casing may further comprise: a lower-half flange coupled with the upper-half flange of the upper-half section; and a leg plate reinforcing rib provided on outside surface of the lower half section at a position of the lower-half flange.

The second wrapper plate reinforcing rib may be coupled with the upper-half flange. The upper-half flange may further comprise an upper half flange projecting portion provided at a coupling position of the second wrapper plate reinforcing rib and the upper-half flange, the upper-half flange projecting portion projecting in a direction along the second wrapper plate reinforcing rib.

The upper-half flange projecting portion may be provided in both sides along the second wrapper plate reinforcing rib. The upper-half flange projecting portion may further include a plurality of flange bolt holes so as to fasten the upper-half section to the lower-half section.

The lower-half section of the casing may further comprise: a lower-half flange coupled with the upper-half flange of the upper-half section; and a leg plate reinforcing rib provided on outside surface of the lower half section at a position of the lower-half flange.

According to the present invention, since the casing rigidity of, in particular, the upper-half portion of the low pressure casing is secured, the resistance of exhaust gases in a flow path is reduced by reducing the number of internal structural members which will be arranged in the low pressure casing, and the exhaust performance of the low pressure casing can be improved.

The nature and further characteristic features of the present invention will be made clearer from the following descriptions made with reference to the accompanying drawings.

DESCRIPTION OF THE PREFERRED EMBODIMENTS

An embodiment of the present invention will be described hereunder with reference to the accompanying drawings.

Figure 1:
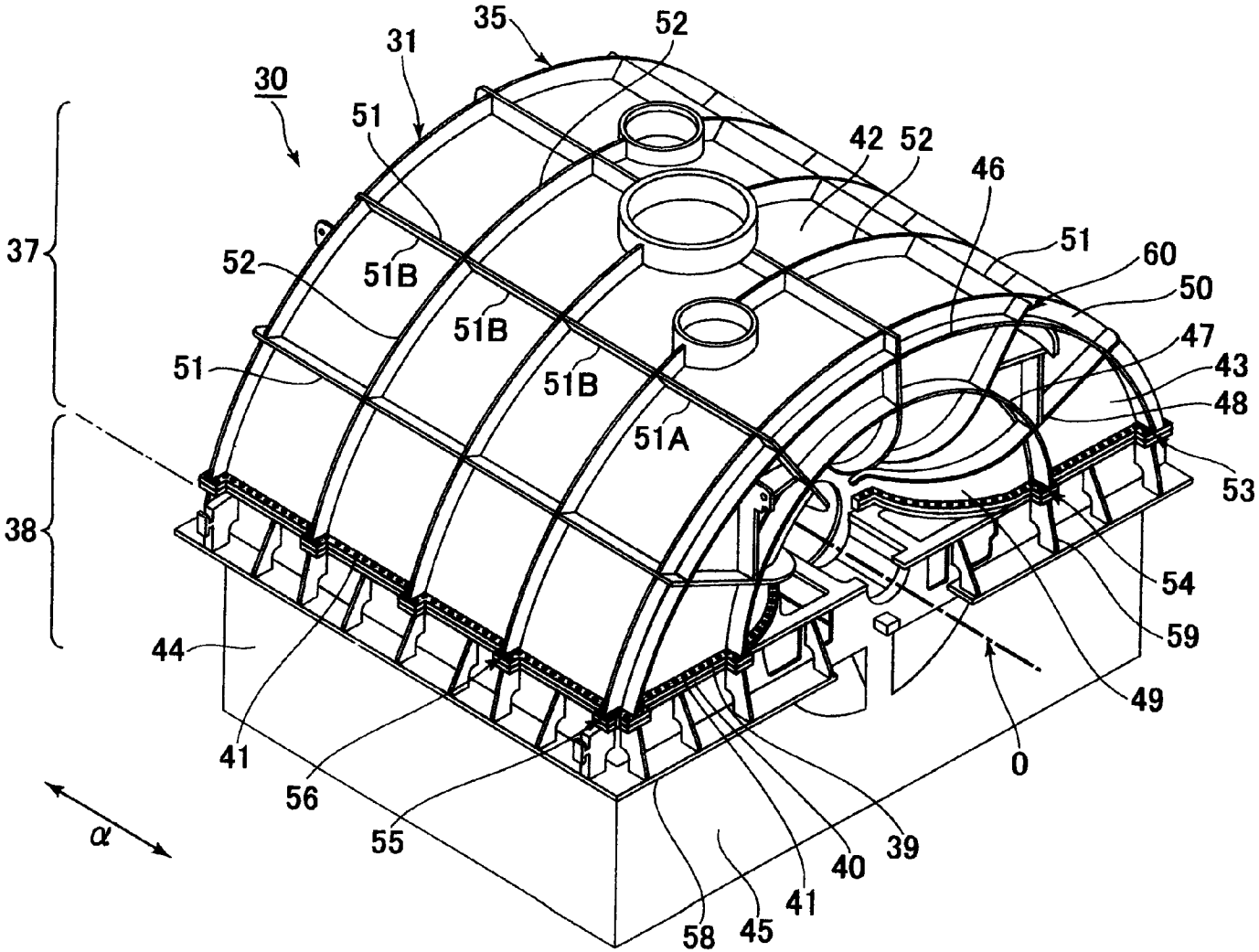
FIG. 1 is a perspective view showing an outer appearance of a low pressure turbine as an embodiment of a steam turbine according to the present invention.
Figure 2:
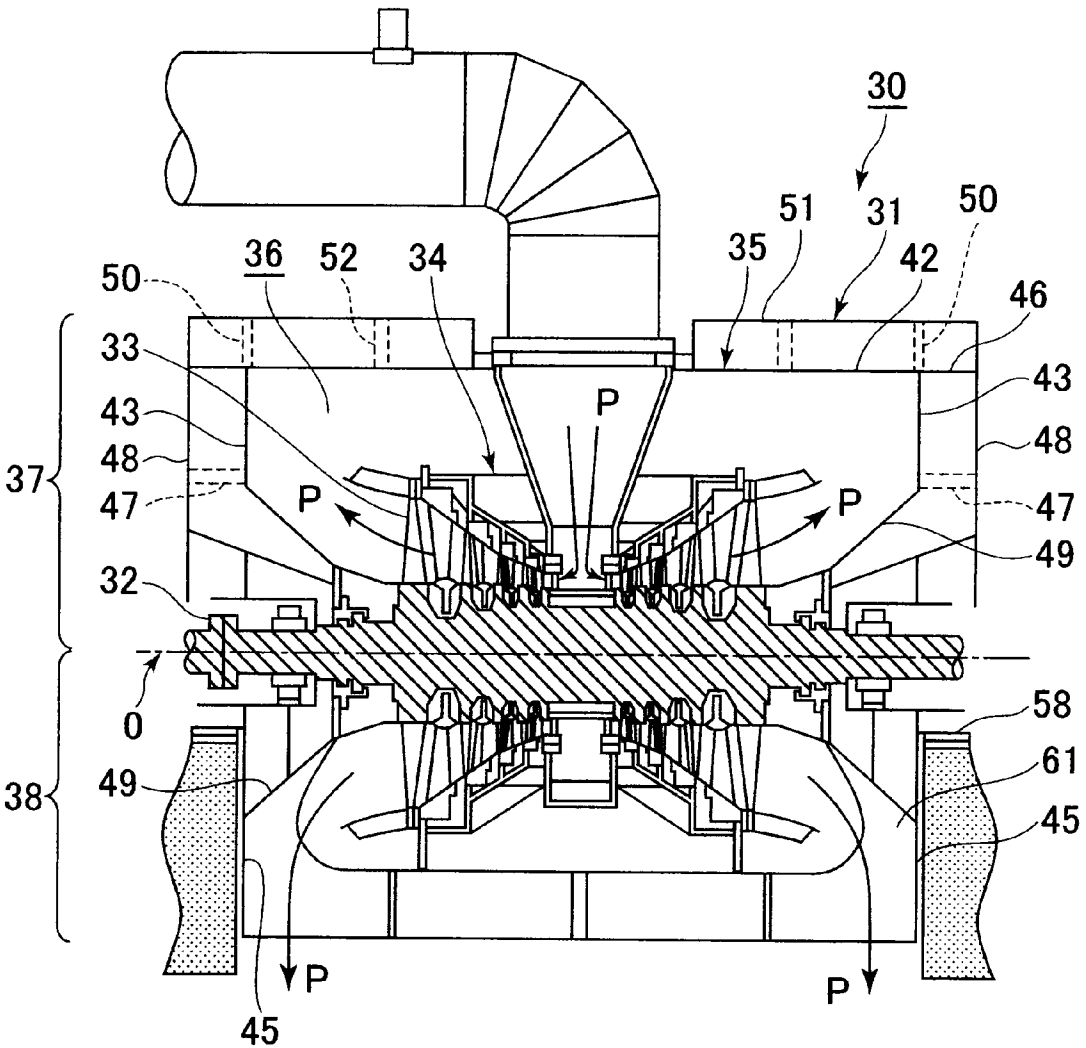
FIG. 2 is a longitudinal section showing the low pressure turbine of FIG. 1.

With reference to FIGS. 1 and 2, a pressure turbine 30 in a steam turbine has a low pressure casing 31 as a pressure vessel in which a turbine rotor 32 is accommodated. The low pressure casing 31 has an internal casing section 34 for covering a movable blade 33 of the turbine rotor 32 and an external casing section 35 disposed outside of the internal casing section 34, and a space between the internal casing section 34 and the external casing section 35 is defined as an exhaust chamber 36. Steam introduced into a central portion of the internal casing section 34 is exhausted into the exhaust chamber 36 as shown by arrows P in FIG. 2 after the turbine rotor 32 rotates, and thereafter, the steam is introduced into a condenser, not shown.

The external casing 35 section of the low pressure casing 31 is divided into an upper-half portion 37 and a lower-half portion 38 by a horizontal surface passing through a rotor axis O of the turbine rotor 32, and the upper-half portion 37 is coupled with the lower-half portion 38 by fastening an upper-half flange 39 and a lower-half flange 40 thereof by means of flange bolts 41.

The upper-half portion 37 of the external casing section 35 is formed in an approximately semi-cylindrical hollow shape in which approximately semi-circular end plates 43 are disposed in confrontation with each other in a direction orthogonal (perpendicular) to the axis of the turbine rotor 32 (radial direction) on both the end sides of an approximately semi-cylindrical wrapper plate 42 which extends in an axial direction of the turbine rotor.

An approximately conical cone 49 is disposed inside of the end plates 43. Further, the lower-half portion 38 of the external casing section 35 is formed in an approximately rectangular prism shape by disposing end plates 45 in confrontation with each other in the direction orthogonal to the axis of the turbine rotor 32 (radial direction) on both the end sides of both side plates 44 disposed in confrontation with each other in the axial direction of the turbine rotor 32.

Figure 3:
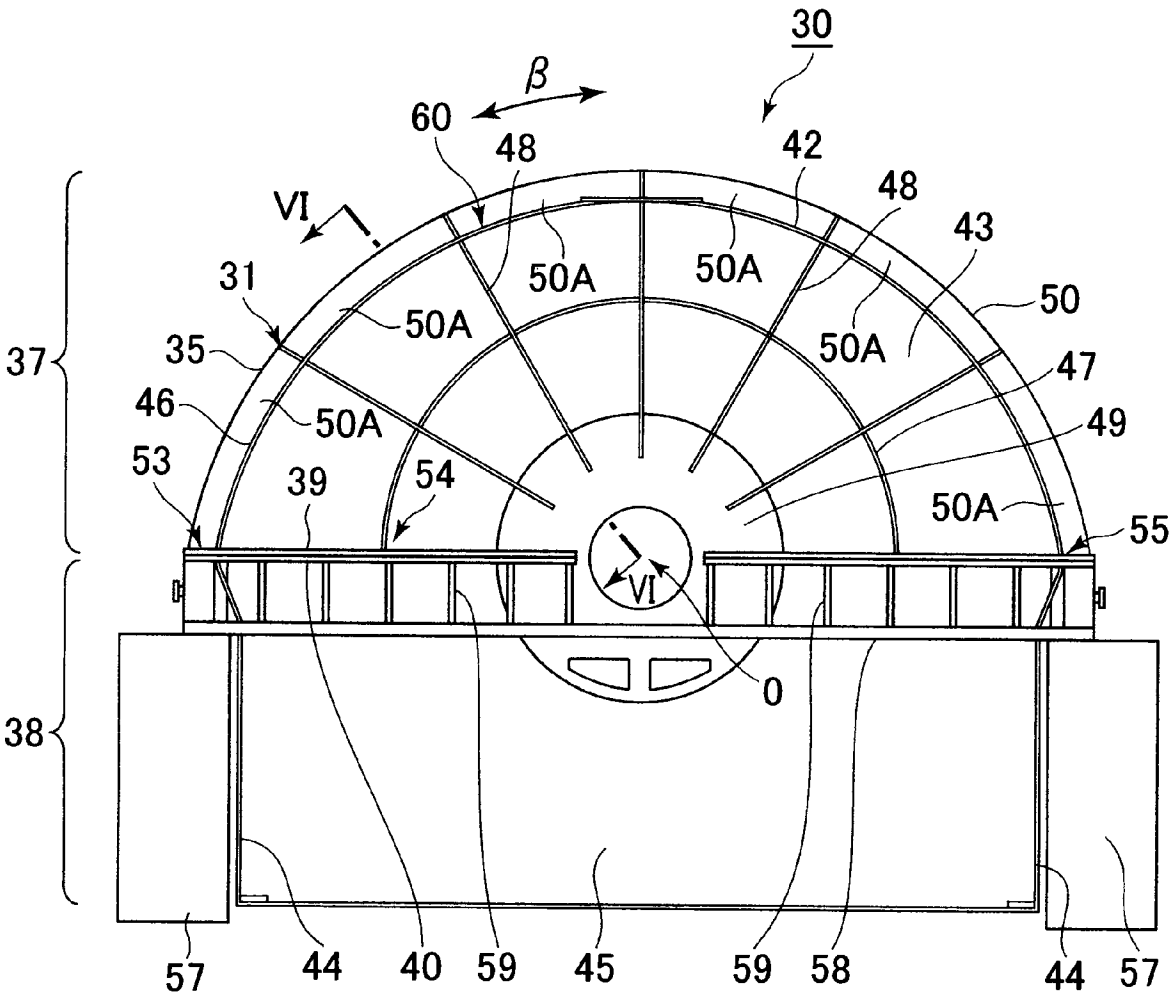
FIG. 3 is a front view showing the low pressure turbine of FIG. 1.

In the upper-half portion 37 of the external casing section 35, the wrapper plate 42 has projecting portions 46 projecting externally from the end plates 43 along the axial direction α. Further, as shown in FIG. 3, the first semi-annular end plate reinforcing ribs 47 are fixed to the outside surfaces of the end plates 43 on the inner peripheral sides of the wrapper plate 42 over the entire lengths of the wrapper plate 42 and the turbine rotor 32 in the peripheral direction β thereof by means of welding, for example.

A plurality of second end plate reinforcing ribs 48, which extend radially about the rotor axis O, are fixed to the outside surfaces of the end plates 43 by means of welding, for example.

As shown in FIGS. 4 to 7, each of the second end plate reinforcing ribs 48 has pieces 48A interposed between the wrapper plate projecting portions 46 and a pieces 48B extending from the first end plate reinforcing ribs 47 to the cone 49. Both the ends of the pieces 48A are fixed to the projecting portions 46 and the first end plate reinforcing ribs 47 by means of welding, for example.

Further, the outside ends of the pieces 48B are fixed to the first end plate reinforcing ribs 47 by means of welding, for example. The projecting portions 46 of the wrapper plate 42 are coupled with the second end plate reinforcing ribs 48 by the pieces 48 of the second end plate reinforcing ribs 48. The end plates 43 are reinforced by the wrapper plate projecting portions 46, the first end plate reinforcing ribs 47, and the second end plate reinforcing ribs 48, thus increasing the rigidity of the end plates 43.

As shown in FIGS. 1 to 4, in the upper-half portion 37 of the external casing section 35, the end plates 43 have end plate projecting portions 50 projecting externally from the wrapper plate. As shown in FIG. 5, each of the end plate projecting portions 50 is composed a plurality of pieces 50A which are divided in the peripheral direction β of the wrapper plate 42, have the same shape, and are fixed to the boundaries between the wrapper plate 42 and the wrapper plate projecting portions 46 by means of welding and the like.

Further, as shown in FIGS. 1 to 4, a plurality of first wrapper plate reinforcing ribs 51 are fixed to the outside surface of the wrapper plate 42 by means of welding, for example, so as to extend in the axial direction α of the wrapper plate 42 on a line which connects a coupling portion 60 of the wrapper plate projecting portions 46 and the second end plate reinforcing ribs 48.

Figure 5:
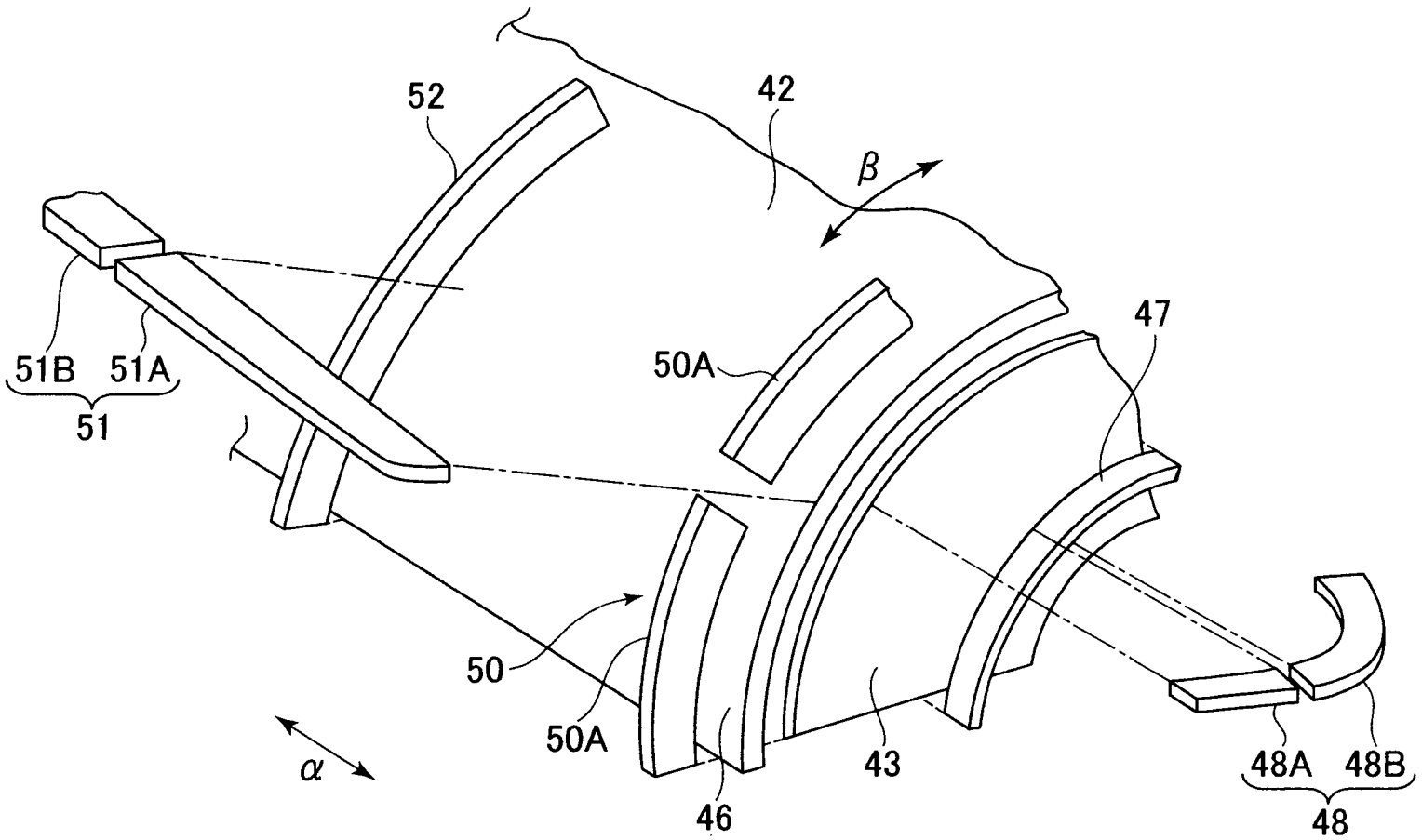
FIG. 5 is an exploded perspective view showing a portion of the low pressure casing of the low pressure turbine of FIG. 1.
Figure 6:
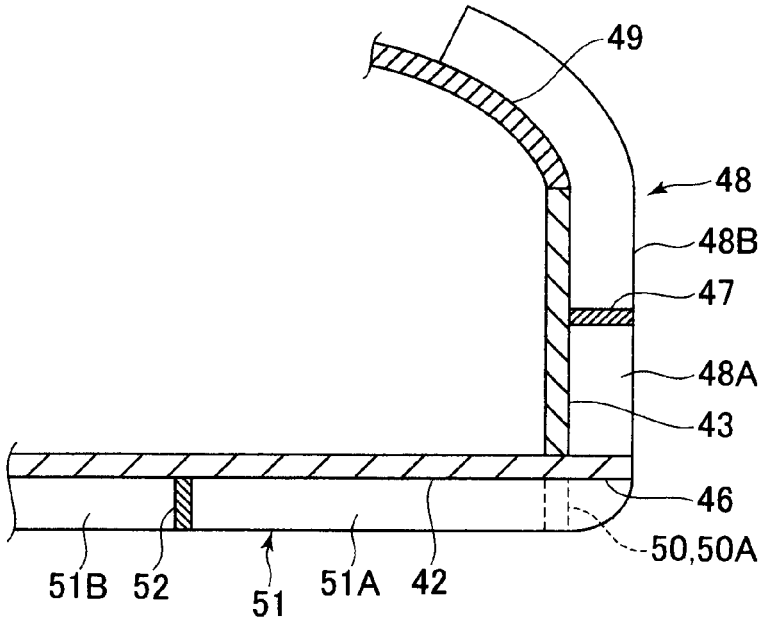
FIG. 6 is an illustrated sectional view taken along the line VI-VI of FIG. 3.
Figure 7:
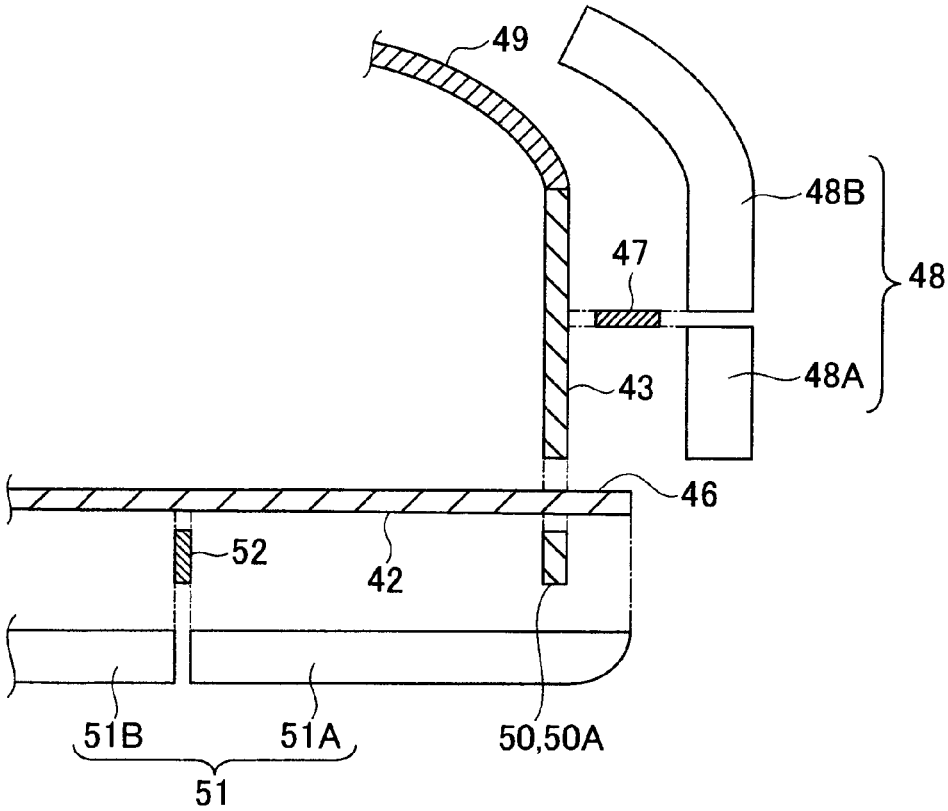
FIG. 7 is an exploded sectional view showing a state that the low pressure casing of FIG. 5 is disassembled at a position corresponding to FIG. 6.

As shown in FIGS. 5 to 7, each of the first wrapper plate reinforcing ribs 51 is composed of a plurality of pieces 51A, 51B divided in the axial direction α of the wrapper plate 42. Among them, one ends of the pieces 51A located on both the end sides of the wrapper plate 42 are interposed between the pieces 50A of the end plate projecting portions 50 and fixed by welding the pieces 50A to the wrapper plate projecting portions 46 to thereby couple the end plate projecting portions 50 with the wrapper plate projecting portions 46*d*.

Furthermore, as shown in FIGS. 1 to 4, semi-annular second wrapper plate reinforcing ribs 52 are fixed to the outside surface of the wrapper plate 42 by means of welding and the like at a plurality of positions in the axial direction α of the wrapper plate 42 which are different with respect to the end plate projecting portions 50 in parallel with the end plate projecting portions 50 in a direction orthogonal to the axial direction α of the wrapper plate 42.

As shown in FIG. 1 and FIGS. 5 to 7, the pieces 51B of the first wrapper plate reinforcing ribs 51 are interposed between the plurality of second wrapper plate reinforcing ribs 52 and both the ends of pieces 51B are fixed to the second wrapper plate reinforcing ribs 52 by means of welding and the like. Further, the other ends of the pieces 51A of the first wrapper plate reinforcing ribs 51 are fixed to the second wrapper plate reinforcing ribs by means of welding and the like. As described above, the wrapper plate 42 is reinforced by coupling the end plate projecting portions 50, the first wrapper plate reinforcing ribs 51, and the second wrapper plate reinforcing ribs 52 with each other in the lattice shape on the outside surface of the wrapper plate 42 as shown in FIG. 1, thus increasing the rigidity of the wrapper plate 42.

Figure 4:
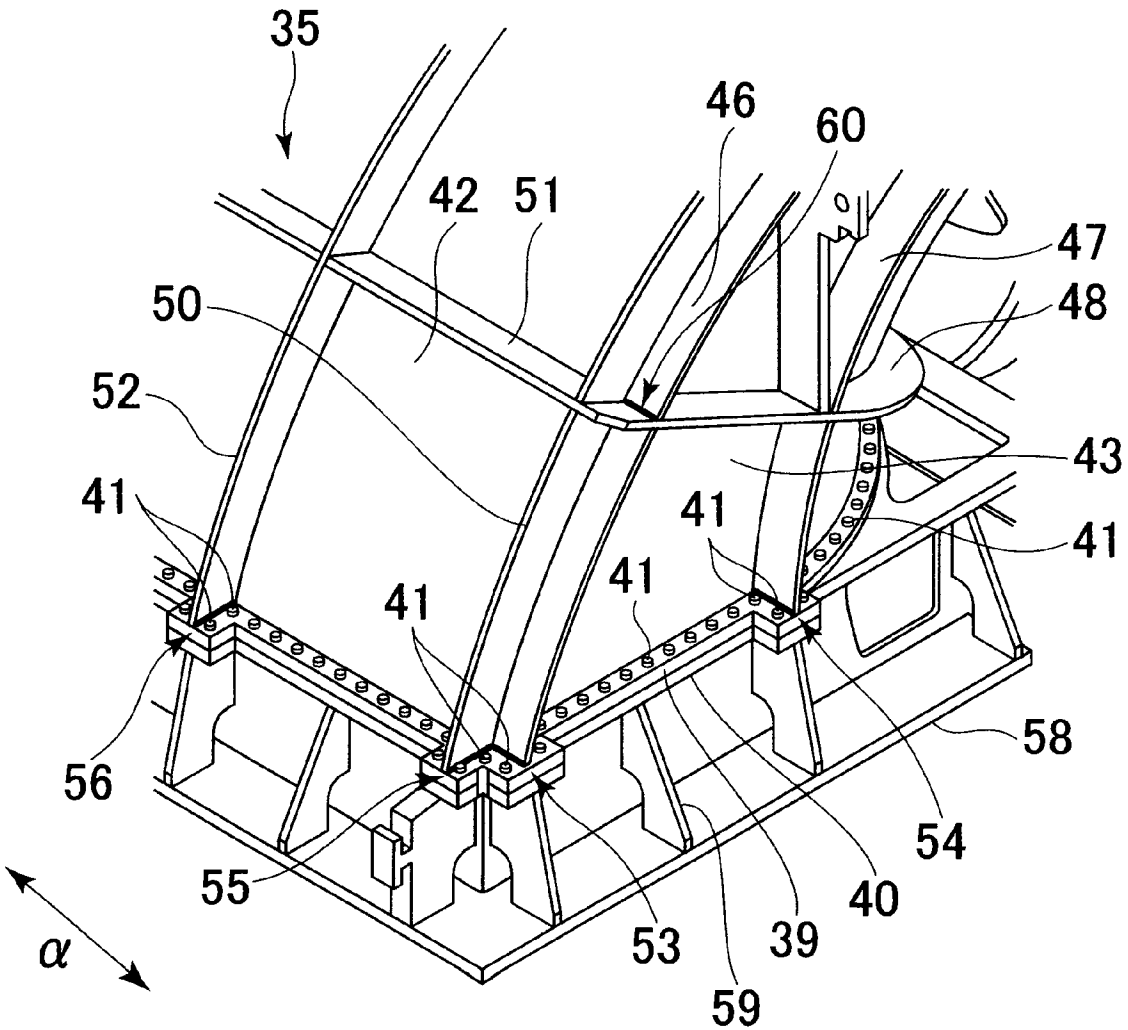
FIG. 4 is a perspective view showing an essential portion of the low pressure turbine of FIG. 1 in an enlarged scale.

As shown in FIG. 4, in the upper-half portion 37 of the external casing 35, the wrapper plate projecting portions 46 and the first end plate reinforcing ribs 47 are coupled with the upper-half flange 39 of the upper-half portion 37 by means of welding, respectively. The upper-half flange 39, which is located in the coupling portion of the wrapper plate projecting portions 46 and the upper-half flange 39 and also located in the coupling portion of the first end plate reinforcing ribs 48 and the upper-half flange 39, is provided with upper-half flange projecting portions 53 and 54 projecting on a flange surface in a direction along the wrapper plate projecting portions 46 and the first end plate reinforcing ribs 47.

The upper-half flange projecting portions 53 and 54 are disposed on both the sides of the wrapper plate projecting portions 46 and the first end plate reinforcing ribs 47 so as to sandwich them therebetween, respectively. It is preferable to form a plurality of bolt holes to both the sides of the upper-half flange projecting portions 53, 54, which are disposed across the wrapper plate projecting portions 46 and the first end plate reinforcing ribs 48, along the projecting direction thereof, respectively and to fasten the upper-half flange projecting portions 53, 54 to the lower-half flange 40 by the plurality of flange bolts 41.

Further, in the described embodiment, the upper-half flange projecting portions 53 and 54 are disposed along both the sides across the first end plate reinforcing ribs 47 and the upper-half flange 39, that is, on both the outer peripheral surface side and the inner peripheral surface side with respect to the wrapper plate projecting portions 46 and the first end plate reinforcing ribs 47.

However, the embodiment is not limited to the above arrangement, and the upper-half flange projecting portions 53 and 54 may be disposed on one sides of the wrapper plate projecting portions 46 and the first end plate reinforcing ribs 47, that is, at least one side of the outer peripheral surface side and the inner peripheral surface side with respect to the wrapper plate projecting portions 46 and the first end plate reinforcing ribs 47. It is also preferable in this case to form a plurality of (for example, two) bolt holes to the upper-half flange projecting portions 53 and 54 along the projecting direction of the wrapper plate projecting portions 46 and the first end plate reinforcing ribs 47 and to fasten the upper-half flange projecting portions 53 and 54 to the lower-half flange 40 by the flange bolts 41.

In addition, in the upper-half portion 37 of the external casing section 35, the end plate projecting portions 50 and the second wrapper plate reinforcing ribs 52 are coupled with the upper-half flange 39 of the upper-half portion 37, respectively, by means of welding and the like.

The upper-half flange 39, which is located in the coupling portion 55 of the end plate projecting portions 50 and the upper-half flange 39 and also located in the coupling portion 56 of the second wrapper plate reinforcing ribs 52 and the upper-half flange 39, is provided with upper-half flange projecting portions 55 and 56 projecting on the flange surface in a direction along the end plate projecting portions 50 and the second wrapper plate reinforcing ribs 52.

The upper-half flange projecting portions 55 and 56 are disposed on both the sides of the end plate projecting portions 50 and the second wrapper plate reinforcing ribs 52 so as to sandwich them, respectively. It is preferable to form a plurality of bolt holes to both the sides of the upper-half flange projecting portions 55 and 56, which are disposed across the end plate projecting portions 50 and the second wrapper plate reinforcing ribs 52, along the projecting direction thereof, respectively and to fasten the upper-half flange projecting portions 55 and 56 to the lower-half flange 40 by the plurality of flange bolts 41.

Furthermore, in the described embodiment, the projecting portions 55 and 56 of the upper-half flange are disposed along both the sides across the end plate projecting portions 50 and the second wrapper plate reinforcing ribs 52, that is, on both the front and rear sides of the wrapper plate 42 in the axial direction $\alpha$ thereof with respect to the end plate projecting portions 50 and the second wrapper plate reinforcing ribs 52. However, the present embodiment is not limited to the above arrangement, and the upper-half flange projecting portion 55 and 56 may be disposed on one sides across the end plate projecting portions 50 and the second wrapper plate reinforcing ribs 52, that is, at least one of the front and rear sides of the wrapper plate 42 in the axial direction a thereof with respect to the end plate projecting portions 50 and the second wrapper plate reinforcing ribs 52.

It is also preferable in this case to form a plurality of (for example, two) bolt holes to the upper-half flange projecting portions 55 and 56 along the projecting direction of the end plate projecting portions 50 and the second wrapper plate reinforcing ribs 52 and to fasten the upper-half flange projecting portions 55 and 56 to the lower-half flange 40 by the plurality of (for example, two) flange bolts 41.

The lower-half flange 40 opposing to the upper-half flange 39 has the same shape as that of the upper-half flange 39, and the upper-half flange 39 including the upper-half flange projecting portions 53, 54, 55 and 56 are fastened to lower-half flange 40 by the flange bolts 41.

As described above, the wrapper plate projecting portions 46 are coupled with the upper-half flange 39 by the upper-half flange projecting portion 53. The first end plate reinforcing ribs 47 are coupled with the upper-half flange 39 by the upper-half flange projecting portion 54. The end plate projecting portions 50 are coupled with the upper-half flange 39 by the upper-half flange projecting portion 55. The second wrapper plate reinforcing ribs 52 are coupled with the upper-half flange 39 by the upper-half flange projecting portion 56.

A plurality of bolt holes and flange bolts 41 are disposed along the projecting direction of the upper-half flange projecting portions 53, 54, 55 and 56. As a result, the wrapper plate projecting portions 46, the first end plate reinforcing ribs 47, the end plate projecting portions 50 and the second wrapper plate reinforcing ribs 52 are connected to the rigid lower-half portion 38 through the upper-half flange 39, the lower-half flange 40, and the flange bolts 41.

As shown in FIGS. 3 and 4, in the lower-half portion 38 of the external casing section 35, a leg plate 58 is disposed to support the low pressure casing 31 by a base 57, and leg plate reinforcing ribs 59 are coupled between the leg plate 58 and the lower-half flange 40.

The leg plate reinforcing ribs 59 are positioned to the lower-half portion 38 side in which at least one of the respective upper-half flange projecting portions 53, 54, 55 and 56 (in the illustrated embodiment, the upper-half flange projecting portions 53, 54, 55 and 56) to at least the wrapper plate projecting portions 46, the first end plate reinforcing ribs 47, the end plate projecting portions 50, the second wrapper plate reinforcing ribs 52, and the upper-half flange 39 is positioned.

The leg plate 58 is reinforced by the leg plate reinforcing ribs 59 disposed as described above, and the lower-half flange 40 is also reinforced against the force transmitted from the wrapper plate projecting portions 46, the first end plate reinforcing ribs 47, the end plate projecting portions 50, and the second wrapper plate reinforcing ribs 52 of the upper-half portion 37 through the upper-half flange 39.

As shown in FIG. 2, a lower-half center rib 61, which couples the inner surfaces of the end plates 45 and the lower portion of the cone 49, is disposed in the lower-half portion 38 to secure the rigidity of the end plates 45 and the cone 49.

According to the arrangement mentioned above, the present embodiment achieves the following advantages and effects (1) to (6).

(1) In the upper-half portion 37 in the external casing section 35 of the low pressure casing 31, the wrapper plate projecting portions 46 of the wrapper plate 42 and the first end plate reinforcing ribs 47 fixed to the outside surfaces of the end plates 43 are arranged as a so-called double annular structure, and the second end plate reinforcing ribs 48 fixed to the outside surfaces of the end plates 43 are coupled with the wrapper plate projecting portions 46 and the first end plate reinforcing ribs 47 at approximately right angles. Accordingly, since the rigidity of the end plates 43 is increased, deformation of the end plates 43 is suppressed. As a result, even if the size of the low pressure casing 31 is increased, the rigidity of the external casing section 35 of the low pressure casing 31, in particular, the rigidity of the upper-half portion 37 of the low pressure casing 31 can be well secured.

Figure 10:
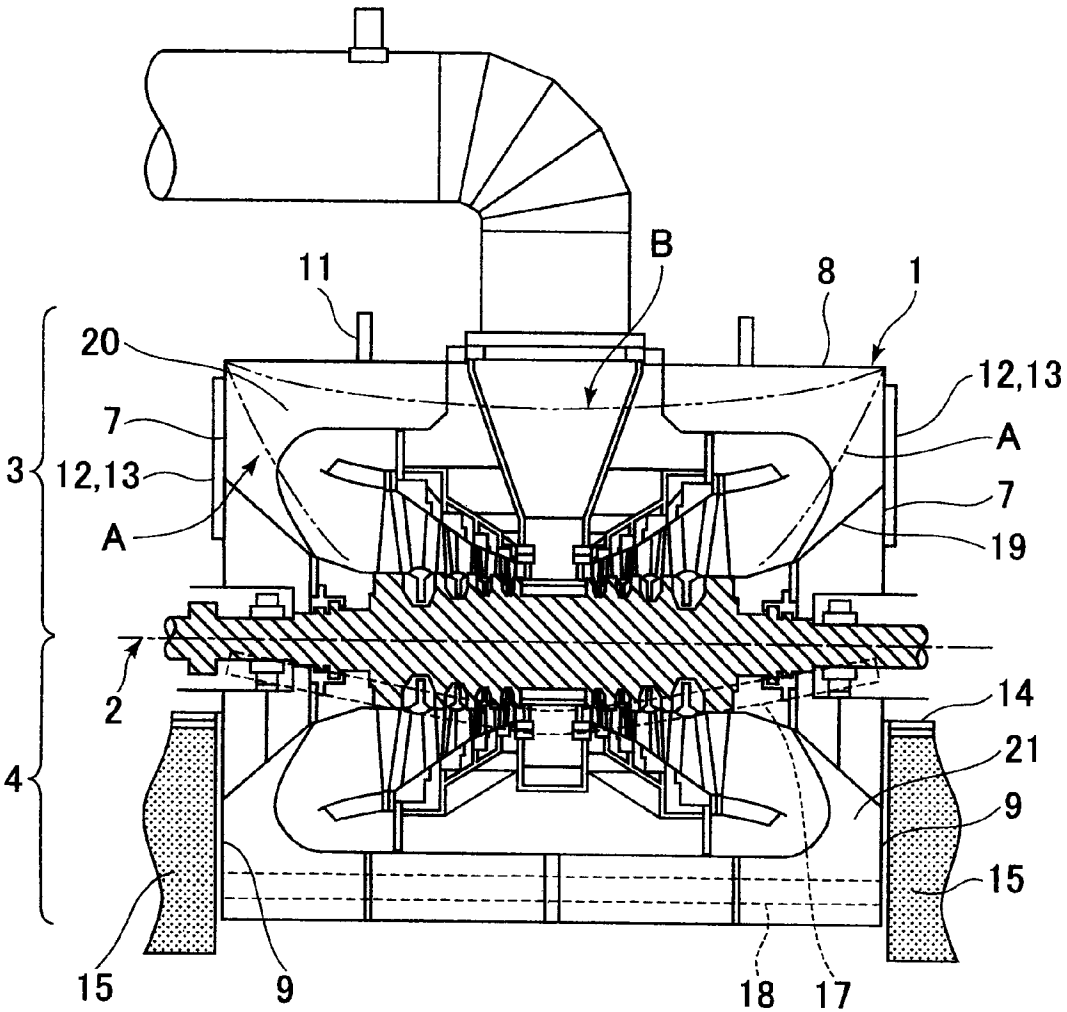
FIG. 10 is a longitudinal sectional view showing the low pressure turbine of FIG. 8 or 9.

(2) In the upper-half portion 37 in the external casing section 35 of the low pressure casing 31, the wrapper plate projecting portions 46 of the wrapper plate 42 are coupled with the end plate projecting portions 50 of the end plates 43 by the first wrapper plate reinforcing ribs 51 fixed to the outside surface of the wrapper plate 42. Accordingly, the rigidity of the casing of the upper-half portion 37 of the external casing section 35 can be well secured, and the wrapper plate 42 and the end plates 43 can be preferably suppressed from being bent about the portion at which they are connected to each other and deformed (refer to two-dot-and-dash-lines A of FIG. 10).

Figure 8:
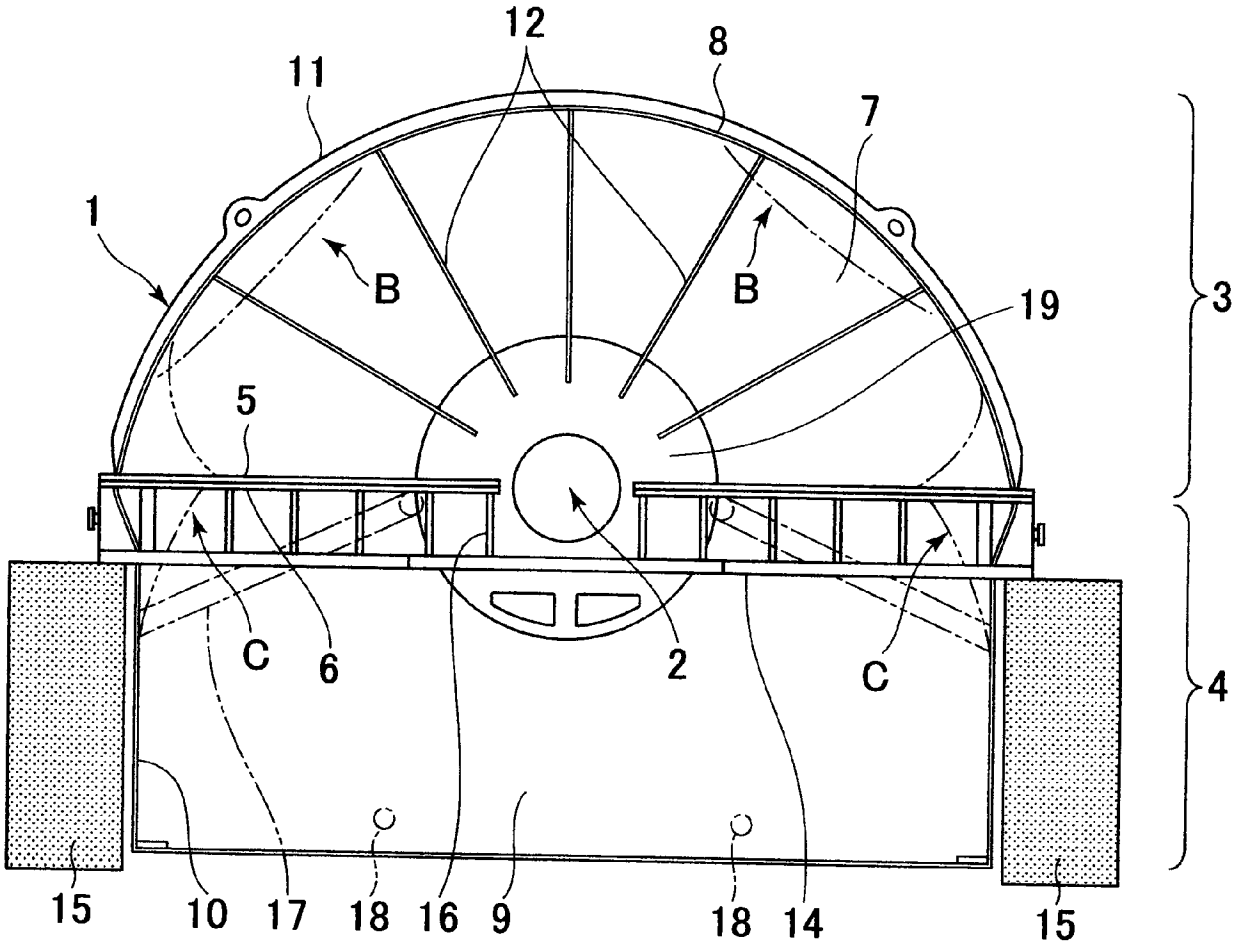
FIG. 8 is a front view showing a structure of a conventional low pressure turbine.

(3) In the upper-half portion 37 in the external casing section 35 of the low pressure casing 31, the end plate projecting portions 50 of the end plates 43 and the first wrapper plate reinforcing ribs 51 and the second wrapper plate reinforcing ribs 52, which are fixed to the outside surface of the wrapper plate 42, are arranged in lattice and coupled with each other. According to this arrangement, since the rigidity of the wrapper plate 42 is increased, it is prevented from being dented inward and deformed in the entirety thereof by the external pressure (refer to two-dot-and-dash-lines B of FIG. 8). As a result, even if the size of the low pressure casing 31 is increased, the rigidity of the external casing section 35 of the low pressure casing 31, in particular, the rigidity of the upper-half portion 37 of the low pressure casing 31, can be well secured.

Figure 9:
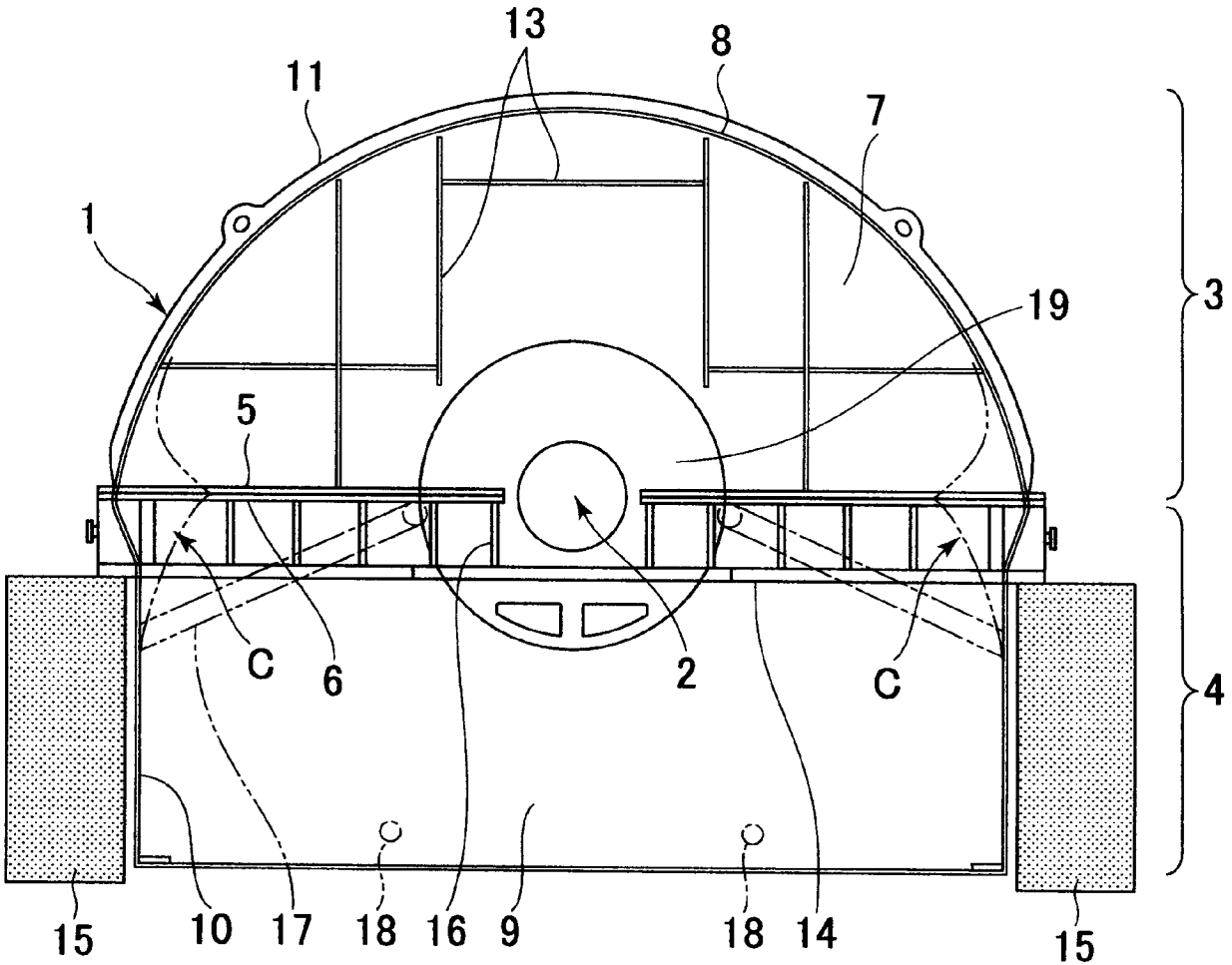
FIG. 9 is a front view showing a structure of another conventional low pressure turbine.

(4) In the upper-half portion 37 in the external casing section 35 of the low pressure casing 31, the wrapper plate projecting portions 46, the first end plate reinforcing ribs 47, the end plate projecting portions 50, and the second wrapper plate reinforcing ribs 52 are coupled with the upper-half flange 39 of the upper-half portion 37 by the upper-half flange projecting portions 53, 54, 55 and 56. In addition, the plurality of flange bolts 41 are disposed along the projecting direction of the upper-half flange projecting portions 53, 54, 55 and 56 on both the sides across the wrapper plate projecting portions 46, the first end plate reinforcing ribs 47, the end plate projecting portions 50, or the second wrapper plate reinforcing ribs 52 of the upper-half flange projecting portions 53, 54, 55 and 56. According to this arrangement, the wrapper plate projecting portions 46, the first end plate reinforcing ribs 47, the end plate projecting portions 50, and the second wrapper plate reinforcing ribs 52 are connected to the rigid lower-half portion 38 through the upper-half flange 39, the lower-half flange 40, and the flange bolts 41, and accordingly, the casing rigidity of the upper-half portion 37 of the external casing 35 can be remarkably improved entirely. Accordingly, the upper-half flange 39 and the lower-half flange 40 can be preferably suppressed from being dented inward and deformed about the portion at which they are fastened to each other (refer to two-dot-and-dash-lines C of FIGS. 8 and 9).

(5) In the lower-half portion 38 in the external casing section 35 of the low pressure casing 31, the leg plate reinforcing ribs 59 for coupling the leg plate 58 with the lower-half flange 40 is at least positioned to the positions corresponding to the respective upper-half flange projecting portions 53, 54, 55 and 56 by which the wrapper plate projecting portions 46, the first end plate reinforcing ribs 47, the end plate projecting portions 50, and the second wrapper plate reinforcing ribs 52 in the upper-half portion 37 are coupled with the upper-half flange 39. Accordingly, the rigidity of the lower-half flange 40 can be secured against the force transmitted from the wrapper plate projecting portions 46, the first end plate reinforcing ribs 47, the end plate projecting portions 50, and the second wrapper plate reinforcing ribs 52 of the upper-half portion 37 through the upper-half flange 39. Thus, the deformation of the lower-half flange 40 can be securely prevented.

(6) As described in the above paragraphs (1) to (5), the end plates 43 of the upper-half portion 37 are reinforced and the rigidity thereof is increased, the wrapper plate 42 of the upper-half portion 37 is reinforced, and the rigidity thereof is increased. The end plates 43 of the upper-half portion 37 and the reinforcing ribs (the wrapper plate projecting portions 46, the first end plate reinforcing ribs 47, the end plate projecting portions 50, and the second wrapper plate reinforcing ribs 52) of the wrapper plate 42 are coupled with the rigid lower-half portion 38 through the upper-half flange 39, so that the rigidity of the upper-half portion 37 is entirely increased. In addition, the rigidity of the lower-half flange 40 of the lower-half portion 38 is secured. Accordingly, the end plates 43 and the wrapper plate 42 are suppressed from being deformed, the end plates 43 and the wrapper plate 42 are suppressed from being bent and deformed about the portion at which the end plates 43 are connected to the wrapper plate 42, and furthermore, the upper-half flange 39 and the lower-half flange 40 are suppressed from being deformed about the portion at which the upper-half flange 39 is fastened to the lower-half flange 40.

As a result of these advantages, since the upper center rib 20 and the pipe stays 17 and 18 as the internal constructions existed in the exhaust chamber 36 of the low pressure casing 31 can be eliminated (refer to FIGS. 18 to 10), the resistance of exhaust gases is reduced in the flow path thereof, and the exhaust performance of the low pressure casing 31 can be improved.

It is to be noted that although the present invention has been explained based on the described embodiment, the present invention is not limited thereto. For example, although the present invention has been explained as to the arrangement in which the low pressure casing has the internal casing section 34 and the external casing section 35, the present invention can be also applied to a steam turbine (low pressure turbine) having such a casing structure in which a low pressure casing has an integral structure not having separated internal casing section and external casing section.

What is claimed is:

1. A steam turbine comprising:

a rotor; and a casing that installs the rotor inside, the casing comprising:

an upper-half section; and a lower-half section, the upper half-section coupled with the lower-half section by an upper-half flange of the upper-half section and a lower-half flange of the lower-half section, wherein the upper-half section includes:

a semi-cylindrical wrapper plate extending in an axial direction of the rotor;

end plates coupled with the wrapper plate, each of the end plates being disposed perpendicular to the rotor, wherein at least one of axial ends of the wrapper plate includes a wrapper plate projecting portion that projects from the corresponding end plates in the axial direction;

a first end plate reinforcing rib disposed on the outside surfaces of the end plates in a peripheral direction of an inner periphery of the wrapper plate; and a plurality of second end plates reinforcing ribs disposed radially on outside surfaces of the end plates, wherein the second end plates reinforcing ribs couple the wrapper plate projecting portion with the first end plate reinforcing rib, wherein the wrapper plate projecting portion is coupled with the upper-half flange, the upper-half flange including an upper-half flange projecting portion provided at a coupling position of the wrapper plate projecting portion and the upper-half flange, the upper-half flange projecting portion projecting in a direction along the wrapper plate projecting portion.

2. The steam turbine according to claim 1, wherein the upper-half section further includes first wrapper plate reinforcing ribs disposed on the outside surface of the wrapper plate, the first wrapper plate reinforcing ribs being provided, in the axial direction, at the wrapper plate projecting portion, and the second end plates reinforcing ribs.

3. The steam turbine according to claim 2, wherein the end plates include an end plate projecting portion that projects from the wrapper plate in a radial direction of the rotor, the first wrapper plate reinforcing ribs coupling the end plate projecting portion with the wrapper plate projecting portion.

4. The steam turbine according to claim 3, wherein the upper-half section further includes a second wrapper plate reinforcing rib disposed on an outside surface of the wrapper plate in parallel with the end plates.

5. The steam turbine according to claim 1, wherein the upper-half flange projecting portion is provided in both sides along the wrapper plate projecting portion.

6. The steam turbine according to claim 1, wherein the upper-half flange projecting portion further includes a plurality of flange bolt holes so as to fasten the upper-half section to the lower-half section.

7. The steam turbine according to claim 1, wherein the lower-half section further includes: a lower-half flange coupled with the upper-half flange of the upper-half section; and a leg plate reinforcing rib provided on an outside surface of the lower half section at a position of the lower-half flange.

8. A steam turbine comprising:

a rotor; and a casing that installs the rotor inside, the casing comprising:

an upper-half section; and a lower-half section, the upper half-section coupled with the lower-half section by an upper-half flange of the upper-half section and a lower-half flange of the lower-half section, wherein the upper-half section includes:

a semi-cylindrical wrapper plate extending in an axial direction of the rotor;

end plates coupled with the wrapper plate, each of the end plates being disposed perpendicular to the rotor, wherein at least one of axial ends of the wrapper plate includes a wrapper plate projecting portion that projects from the corresponding end plates in the axial direction;

a first end plate reinforcing rib disposed on the outside surfaces of the end plates in a peripheral direction of an inner periphery of the wrapper plate; and a plurality of second end plates reinforcing ribs disposed radially on outside surfaces of the end plates, wherein the second end plates reinforcing ribs couple the wrapper plate projecting portion with the first end plate reinforcing rib, wherein the first end plate reinforcing rib is coupled with the upper-half flange, the upper half-flange including an upper half-flange projecting portion provided at a coupling position of the first end plate reinforcing rib and the upper-half flange, the upper-half flange projecting portion projecting in a direction along the first end plate reinforcing rib.

9. The steam turbine according to claim 8, wherein the upper-half flange projecting portion is provided in both sides along the first end plate reinforcing rib.

10. The steam turbine according to claim 8, wherein the upper-half flange projecting portion further includes a plurality of flange bolt holes so as to fasten the upper-half section to the lower-half section.

11. The steam turbine according to claim 8, wherein the lower-half section further includes: a lower-half flange coupled with the upper-half flange of the upper-half section; and a leg plate reinforcing rib provided on an outside surface of the lower half section at a position of the lower-half flange.

12. A steam turbine comprising:

a rotor: and a casing that installs the rotor inside, the casing comprising:

an upper-half section; and a lower-half section, the upper half-section coupled with the lower-half section by an upper-half flange of the upper-half section and a lower-half flange of the lower-half section, wherein the upper-half section includes:

a semi-cylindrical wrapper plate extending in an axial direction of the rotor;

end plates coupled with the wrapper plate, each of the end plates being disposed perpendicular to the rotor, wherein at least one of axial ends of the wrapper plate includes a wrapper plate projecting portion that projects from the corresponding end plates in the axial direction;

a first end plate reinforcing rib disposed on the outside surfaces of the end plates in a peripheral direction of an inner periphery of the wrapper plate; and a plurality of second end plates reinforcing ribs disposed radially on outside surfaces of the end plates, wherein the second end plates reinforcing ribs couple the wrapper plate projecting portion with the first end plate reinforcing rib, wherein an end plate projecting portion is coupled with the upper-half flange, the upper half-flange including an upper-half flange projecting portion provided at a coupling position of the end plate projecting portion and the upper-half flange, the upper-half flange projecting portion projecting in a direction along the end plate projecting portion.

13. The steam turbine according to claim 12, wherein the upper-half flange projecting portion is provided in both sides along the end plate projecting portion.

14. The steam turbine according to claim 12, wherein the upper-half flange projecting portion further includes a plurality of flange bolt holes so as to fasten the upper-half section to the lower-half section.

15. The steam turbine according to claim 12, wherein the lower-half section further includes: a lower-half flange coupled with the upper-half flange of the upper-half section; and a leg plate reinforcing rib provided on an outside surface of the lower half section at a position of the lower-half flange.

16. A steam turbine comprising:

a rotor; and a casing that installs the rotor inside, the casing comprising:

an upper-half section; and a lower-half section, the upper half-section coupled with the lower-half section by an upper-half flange of the upper-half section and a lower-half flange of the lower-half section, wherein the upper-half section includes:

a semi-cylindrical wrapper plate extending in an axial direction of the rotor;

end plates coupled with the wrapper plate, each of the end plates being disposed perpendicular to the rotor, wherein at least one of axial ends of the wrapper plate includes a wrapper plate projecting portion that projects from the corresponding end plates in the axial direction;

a first end plate reinforcing rib disposed on the outside surfaces of the end plates in a peripheral direction of an inner periphery of the wrapper plate; and a plurality of second end plates reinforcing ribs disposed radially on outside surfaces of the end plates, wherein the second end plates reinforcing ribs couple the wrapper plate projecting portion with the first end plate reinforcing rib, wherein a second wrapper plate reinforcing rib is coupled with the upper-half flange, the upper-half flange including an upper half flange projecting portion provided at a coupling position of the second wrapper plate reinforcing rib and the upper-half flange, the upper-half flange projecting portion projecting in a direction along the second wrapper plate reinforcing rib.

17. The steam turbine according to claim 14, wherein the upper-half flange projecting portion is provided in both sides along the second wrapper plate reinforcing rib.

18. The steam turbine according to claim 14, wherein the upper-half flange projecting portion further includes a plurality of flange bolt holes so as to fasten the upper-half section to the lower-half section.

19. The steam turbine according to claim 14, wherein the lower-half section further includes: a lower-half flange coupled with the upper-half flange of the upper-half section; and a leg plate reinforcing rib provided on an outside surface of the lower half section at a position of the lower-half flange.

* * * * *